United States Patent [19]

Gougeon

[11] 4,450,991

[45] May 29, 1984

[54] FABRIC MADE CHAIR FOR FACILITATING TRANSPORTATION OF A DISABLED PERSON

[76] Inventor: Jacques Gougeon, 4533 Delorimier Ave., Montreal, Quebec, Canada, H2H 2P4

[21] Appl. No.: 343,316

[22] Filed: Jan. 27, 1982

[30] Foreign Application Priority Data

Jul. 6, 1981 [CA] Canada ..... 381201

[51] Int. Cl.[3] ..... A47D 13/02

[52] U.S. Cl. ..... 224/159; 224/202; 224/901; 294/140

[58] Field of Search ..... 224/158, 159, 160, 901, 224/257, 161, 155, 156, 157, 202; 294/140; 119/96; 24/31 V, 204; 297/188

[56] References Cited

U.S. PATENT DOCUMENTS

| | | | |
|---|---|---|---|
| D. 138,791 | 9/1944 | Horckitz | 294/140 X |
| 1,035,642 | 8/1912 | Rosse | 294/140 |
| 1,328,832 | 1/1920 | Hanrath | 294/140 |
| 1,971,294 | 8/1934 | Bunker | 224/159 X |
| 2,468,588 | 4/1949 | Clemens . | |
| 2,477,164 | 7/1949 | Bergman . | |
| 2,533,135 | 12/1950 | McKenzie | 224/257 |
| 2,535,683 | 12/1950 | Kimball . | |
| 2,689,672 | 9/1954 | Thompson . | |
| 3,254,815 | 6/1966 | Bugge . | |
| 3,327,914 | 6/1967 | Abram . | |
| 4,037,764 | 7/1977 | Almosnino et al. | 224/901 X |
| 4,096,977 | 6/1978 | Barville et al. | 224/901 X |
| 4,166,558 | 9/1979 | Schroeder . | |
| 4,220,302 | 9/1980 | Hampton et al. | 224/901 X |
| 4,234,229 | 11/1980 | Arnold | 224/160 X |

FOREIGN PATENT DOCUMENTS

| | | | |
|---|---|---|---|
| 126761 | 2/1948 | Australia | 224/159 |
| 1001479 | 2/1952 | France | 224/159 |

*Primary Examiner*—Allan N. Shoap
*Assistant Examiner*—Robert Petrik
*Attorney, Agent, or Firm*—Schwartz, Jeffery, Schwaab, Mack, Blumenthal & Koch

[57] ABSTRACT

A chair made of flexible material for facilitating transportation of a disabled person and more particularly a disabled child by a healthy person. The chair comprises a large piece of material forming the seat of the chair on which the disabled person may sit, and a plurality of straps allowing distribution of the weight of the disabled person seated on the chair onto the shoulder and the arms of the person who is transporting him or her when the person is erect. To accomplish this weight distribution, one of the straps of the chair is fixed to the front end of the seat and provided with a loop pile and hook fastener. The first strap is of a sufficient length to surround the thighs of the disabled person and to be fixed around the disabled persons' thighs by a fastener when the disabled person is seated on the chair. This first strap acts as a first handle for lifting and transporting the disabled person. Another strap is fixed substantially in the middle of the seat in order to support the main part of the weight of the disabled person. This other strap is of a sufficient length to surround the shoulder of the person transporting the disabled individual when this person is erect. Last of all, a handle consisting of a third strap is fixed to the rear end of the seat to allow engagement by the fingers of the person transporting the disabled individual. The chair is particularly useful because it provides a comfortable seat for the disabled individual and is very light and easy to fold and store.

8 Claims, 3 Drawing Figures

FABRIC MADE CHAIR FOR FACILITATING TRANSPORTATION OF A DISABLED PERSON

BACKGROUND OF THE INVENTION

1. Field of the Invention

The present invention relates to a chair made of a flexible material such as fabric for facilitating transportation of a disabled individual, and more particularly, a disabled child by a healthy person.

2. Description of the Relevant Art

Numerous chairs or carriers made of fabric for facilitating transportation of a baby or an infant have already been proposed and form the subject matter of several U.S. Patents, for example, U.S. Pat. Nos. 2,468,588, 2,477,164, 2,535,683, 2,689,672, 3,254,815, 3,327,914, and 4,166,558. Generally, these carriers or chairs, made of fabric which are already known, comprise a plurality of straps fixed to each other by means of complicated buckles. The straps support a plurality of detachable walls on or in which the baby or child can be seated or laid. As the weight of a baby or child is relatively light, nothing is provided for ensuring good distribution of the weight onto the arms or shoulders of the person carrying the child. Moreover, most of the known chairs or carriers have a relatively complicated structure and require continued, exact adjustment.

It is also known that the transportation of disabled individuals and more particularly a disabled child, having a body weight as high as 100 pounds, can cause substantial difficulties for the person who has to carry him or her. Indeed, it is difficult for a healthy adult to manually lift such a load, and this task is almost impossible for those of slight build, unless the load can be evenly distributed onto the whole body of the person doing the carrying and particularly onto his or her shoulders and arms.

In accordance with the present invention, it has been surprisingly found that, by using a seat made of flexible material such as fabric provided with a set of straps properly located, it is possible to provide a more substantially comfortable seat for a disabled individual. The seat is, moreover, very handy to use and allows someone having an average physical constitution to easily carry a disabled child and even a disabled adult having a body weight of up to 100 pounds.

It has also surprisingly been found that, for positioning and adjusting the straps of such a carrier, loop pile and hook fasteners sold under the registered trademark "VELCRO" are sufficient in spite of the substantial loads to be carried. Consequently, it is unnecessary to employ heavy metal fasteners which are difficult to use, as has been the usual practice, for the transportation of babies or very young infants having small body weights.

OBJECTS AND SUMMARY OF THE INVENTION

It is an object of the instant invention to provide a light-weight, easily stored carrying device for transporting individuals, particularly handicapped children.

Another object is to provide a carrying device which evenly distributes the weight of the individual seated in the device over the shoulder and arms of the person who does the carrying.

It is a further object to provide a carrying device which can be easily used by persons of slight build to lift and carry another individual, particularly a handicapped child.

It is still another object of the invention to provide a carrying device which eliminates the complications and inconvenience of using metal fasteners.

It is still further the object of the invention to provide a carrier adapted for transporting individuals weighing up to approximately 100 pounds.

The above objects are accomplished by providing a carrier completely made of flexible material, such as fabric, for facilitating transportation of a disabled child by a healthy person.

The carrier or chair comprises a large piece of material forming the seat on which the disabled individual may sit. This piece is of sufficient length to extend under the thighs and around the back of the disabled individual and to make him or her much more comfortable.

A first strap made of two pieces is fixed, substantially across the front of the seat and is provided with a loop pile and hook fastener. This first strap is of a sufficient length to surround the thighs of the disabled individual and to be fixed by the fastener around the same when the disabled individual is sitting in the seat.

The carrier also comprises a handle fixed to the rear end of the seat so as to be easily grasped by the carrying person's fingers.

Finally, the carrier comprises a second strap made of two pieces fixed to the seat substantially in the middle thereof and provided with a loop pile and hook fastener. This second strap is of sufficient length to surround the shoulder of the person transporting the disabled individual. When the transporting person is erect, he holds the disabled individual seated on the seat by grasping the first strap and the handle of the seat with his hands.

The first and second straps and the handle positioned on the seat behind the back of the disabled individual permits an excellent distribution of the load onto the shoulder and arms of the person carrying the disabled individual, and thus substantially facilitates the lifting and transporting of the disabled individual, even by one who is not very strong.

As indicated above, the fasteners used for fixing the straps are of the loop pile of hook type. Indeed, this kind of fastener has proved to be sufficient for maintaining the straps in closed position, even under loads as high as 100 pounds.

In one embodiment of the invention, the handle at the rear of the seat consists of a third strap partially fixed to the rear end of the seat to allow engagement of the fingers of the person transporting the disabled individual. Two ends of this third strap are fixed to a pair of second straps and support the pelvis of the disabled individual.

In another embodiment of the invention, a fourth strap parallel and superior to the third one is provided. This fourth strap acts as a back support for the disabled individual and further improves comfort of the carrying device.

BRIEF DESCRIPTION OF THE DRAWINGS

The invention and its advantages will be more apparent from the following description, taken together with the accompanying drawings, wherein.

DESCRIPTION OF A PREFERRED EMBODIMENT

A carrying device 1 shown in the accompanying drawings is made of fabric and its constituent pieces are sewn to each other and may optionally have reinforcing seams. Obviously, other flexible materials such as, for example, plastic fabric may also be used in lieu of a conventional fabric.

The carrying device 1 made of fabric is designed to allow a carrying person P to facilitate transportation of a disabled individual H and more particularly a disabled child, whose body weight may be as much as 100 pounds. The structure of the device provides for excellent distribution of the load and therefore facilitates the lifting and transportation of the disabled individual H while avoiding the type of back injury or strain which frequently afflicts individuals who must carry unassisted a very heavy load in his or her arms.

Figure 2:
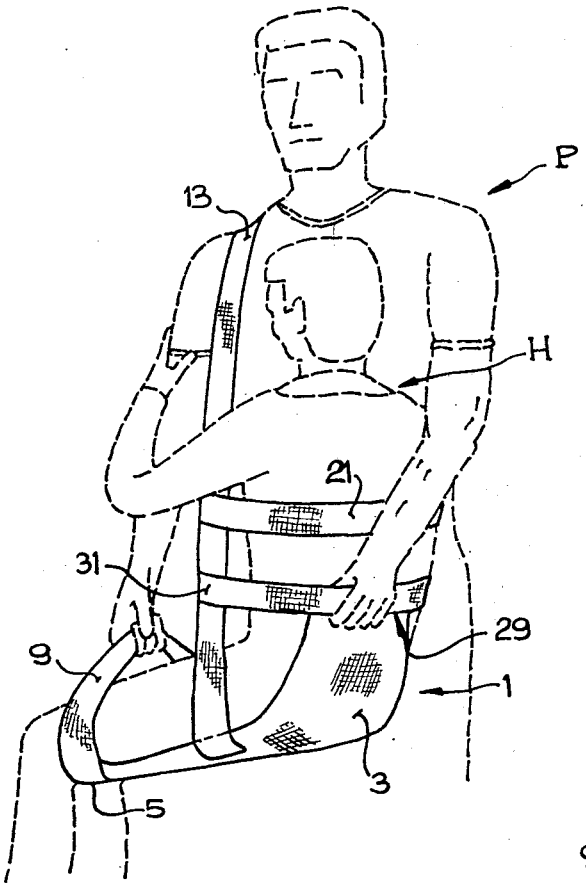
FIGS. 2 and 3 illustrate the carrying device depicted in FIG. 1 in use.
Figure 3:
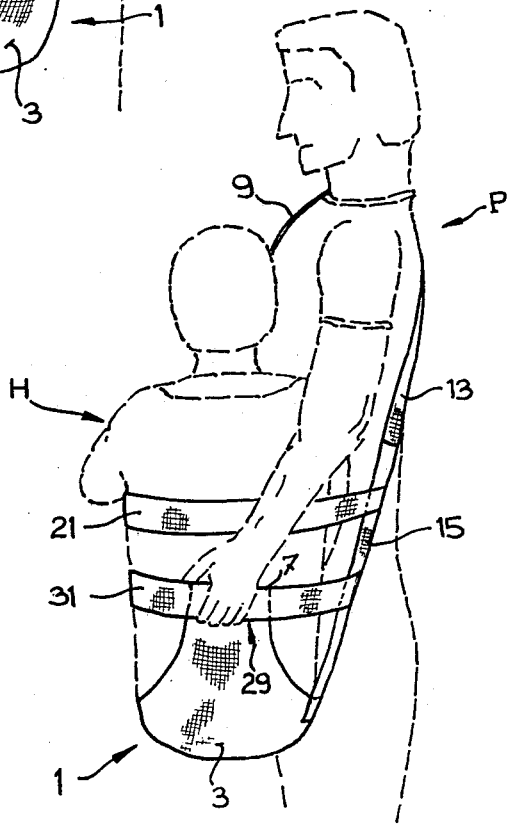

The carrying device 1 comprises, as a main element, a large piece of fabric 3, having a generally substantially oval shape, although other shapes could equally be used. This large piece 3 forms the seat on which the disabled individual may sit during his or her transportation. To make the disabled individual much more comfortable, the seat 3 is of sufficient length that a first end 5 extends forward under the thighs of the disabled individual as indicated in FIG. 2, and the other end 7 extends up the disabled individual's back as depicted in FIG. 3. Thus, the large piece 3 forms a complete seat providing a maximum amount of comfort to the disabled individual H being transported.

Figure 1:
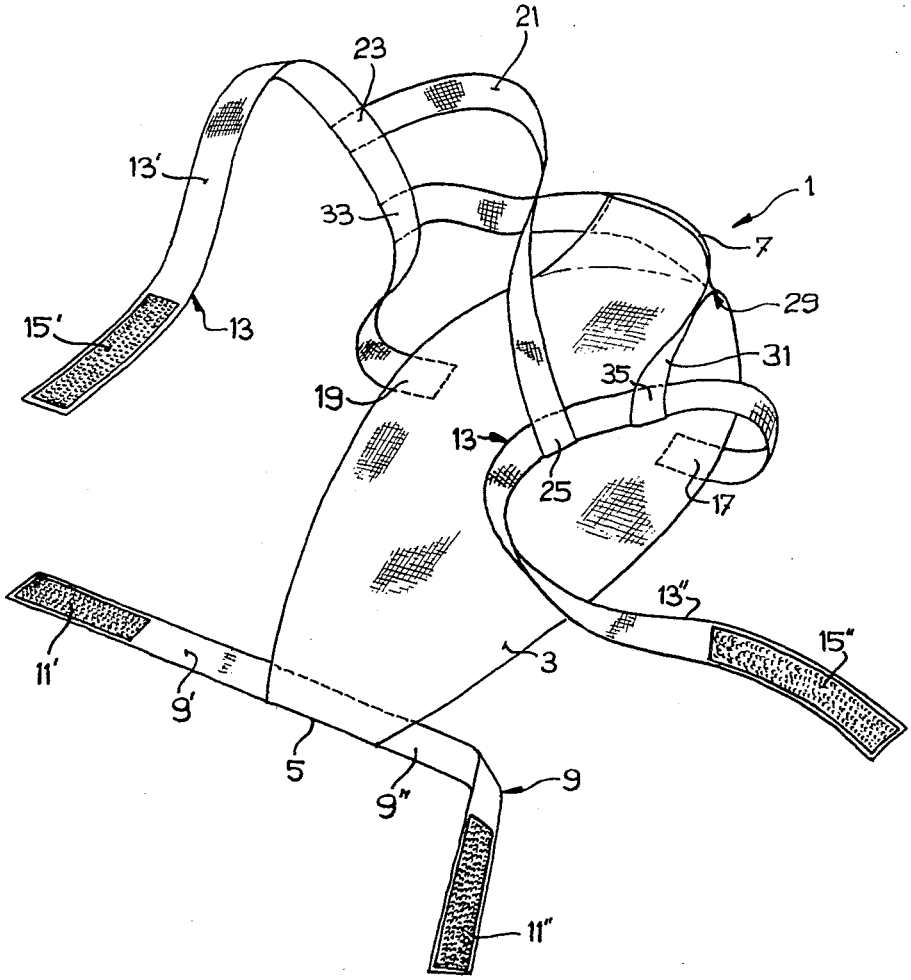
FIG. 1 is a perspective view of a carrying device according to the invention in semi-unfolded form.

A first strap 9 made of two pieces 9' and 9'' is sewn to the front end 5 of the seat. This first strap can comprise one single piece of fabric sewn in its middle as shown in FIG. 1 or it can comprise separate pieces of fabric respectively joined in line. This first strap 9 is joined to the seat substantially perpendicular to the longitudinal axis of the seat, and its length is sufficient to surround the thighs of the disabled individual, as shown in FIG. 2 and to be fastened therearound when the disabled individual is seated in the fabric seat. To provide for fastening the first strap, a pair of loop pile and hook fasteners 11' and 11'' are respectively fixed to the ends of the pieces 9' and 9'' of the strap 9. By applying these two loop pile and hook fasteners 11' and 11'' one against the other, one can close the strap 9 in a very simple manner and assure a strong closure thereof. It is quite obvious that the longer the lengths of the loop pile and hook pieces 11' and 11'', the stronger is the fastener. Consequently, the lengths of the pieces 11' and 11'' will be chosen as a function of the load that is to be transported with the chair 1.

To provide a good distribution of the weight of the disabled individual H not only on the arms but also on the shoulder of the carrying person P, a second strap 13 also made of a pair of pieces 13' and 13'' of fabric is joined to the seat 3, substantially in the middle thereof, as is clearly shown in FIG. 1. This second strap is provided at each of its respective ends 13' and 13'' with a loop pile and hook fastener 15' and 15'' in order to firmly attach the straps 13' and 13'' to each other. The comments above as to the strength of the attachment can be applied to the size of the loop pile and hook fasteners used. This second strap can also be made of a single piece of fabric sewn across the seat, or of two separated pieces as illustrated in FIG. 1, that are respectively sewn by their ends 17 and 19 to the edges of the seat 3. The length of this strap is chosen so that it may surround the shoulder of the carrying person P transporting the disabled individual when this person stands up and holds the disabled individual seated in the carrying device as shown in FIGS. 2 and 3, by simultaneously grasping with his or her hands the first strap 9 when this strap is closed and an additional handle 29 fixed at the rear end 7 of the seat.

The handle 29 is advantageously formed by the third strap 31 which is joined to the rear end 7 of the seat 3 in a manner permitting the transporting person to grasp the handle 29 with his fingers as shown in FIGS. 2 and 3. For this purpose, the third strap 31 can be sewn just under the edge of the end 7 of the seat and on both sides thereof to form an open band which the fingers may easily grasp. The third strap 31 forming the handle extends on both sides at the rear end of the seat 3 and is joined by its ends 33 and 35 to the second strap 13. This third strap 31, is located just behind the pelvis of the disabled individual H when the disabled individual is seated in the carrier. This connection of the third strap to the second strap advantageously holds the back of the disabled individual in a firm manner and facilitates his or her transportation and makes his or her seated position much more comfortable.

In a further preferred embodiment, a fourth strap 21 can be used for further improving the comfort of the disabled individual by providing a back support for him or her. In order to act as a back support, this fourth strap 21 is mounted parallel to the third strap 31 and is connected by its ends 23 and 25 to the second strap 13.

In use, after having seated the disabled individual in the seat 3 and attached the pieces of each strap 9 and 13 with the loop pile and hook fasteners 11', 11'' and 15', 15'', the carrying person can place the strap 9 around his or her shoulder and, by simultaneously grasping with his or her hands, the strap 9 surrounding the thighs of the disabled individual near the knees and the handle 29 located behind the back respectively, lift the disabled individual without any risk of back strain or injury. The handle and the straps give a perfect distribution of the load on the shoulder and the arms of the carrying person. Once the carrying person is erect, he can easily transport the disabled individual without any risk to his or her back or excessive fatigue. At the same time, the disabled individual H is comfortably seated.

Once the disabled individual has been transported, the loop pile and hook fasteners 11', 11'' and 15', 15'' are separated to free the seat which can be very easily folded and put away because of its flexible structural material.

It is interesting to note that small pieces of loop pile and hook fasteners are surprisingly adequate for firmly closing the straps 9 and 13. This obviously would not be foreseen in view of what has been proposed up to now in this particular field of fabric carrying devices.

Of course, it is not necessary that the two pieces forming the straps 9 and 13 be of the same length. On the contrary, it is even preferable that these two pieces be of different lengths to facilitate the attachment of their loop pile and hook fasteners and to avoid locating the fasteners at the curvature of the shoulder or in the middle of the hand.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A carrying device comprising:
(a) a piece of flexible material forming seat means, said seat means having two ends;
(b) a first strap means joined to said seat means at one end thereof, said first strap means having two ends, said two ends provided with loop pile and hook fasteners;
(c) a second strap means joined to said seat means, said second strap means having two ends provided with loop pile and hook fasteners; and
(d) handle means joined to said seat means at the other end thereof, said handle means having two extended ends, each of said ends being joined to said second strap means at a point substantially intermediate each of said ends of said second strap means and said seat means.

2. The carrying device defined in claim 1 including a fourth strap means having a pair of ends attached to said second strap means above said extended ends of said handle means.

3. A carrying device for facilitating transportation of a disabled individual by a carrying person comprising:
(a) a piece of flexible material forming seat means on which the disabled individual may sit, said seat means having two ends, said seat means having sufficient length to extend substantially from under the thighs of the disabled individual to the back of the disabled individual;
(b) a first strap means joined to said seat means at one end thereof, said first strap means having two ends, loop pile and hook fasteners provided on said two ends of said first strap means, said first strap means being of sufficient length to fix the two ends thereof together surrounding the thighs of said disabled individual when said disabled person is seated in said carrying device;
(c) handle means joined to said seat means at the other end thereof;
(d) second strap means joined to said seat means intermediate to the ends thereof; said second strap means having two ends, loop pile and hook fasteners provided thereon, said second strap means being of sufficient length to surround the shoulder of said carrying individual when said carrying individual stands erect holding said first strap means and said handle means;
(e) said handle means having two extended ends, each of said ends being joined to said second strap means at a point substantially intermediate each of said ends of said second strap means and said seat means, whereby said extended handle forms a third strap means supporting said disabled individual.

4. The carrying device defined in claim 3 further comprising a fourth strap means, said fourth strap means having ends attached to said second strap means above said third strap means whereby said fourth strap means supports the disabled individual's back.

5. The carrying device defined in claims 1 or 3 wherein said flexible material is fabric and said strap means and said seat means are joined to each other by a plurality of seams.

6. A method of carrying a physically handicapped individual by a transporting person comprising the steps of:
(a) providing a seat of a piece of flexible material, seating a handicapped individual on said seat, said seat having two ends, extending the first end thereof under the thighs of the individual and the second end thereof along the back of the individual;
(b) providing a first strap joined to said seat substantially at said first end thereof, said strap having two ends and providing loop pile and hook fasteners thereon;
(c) surrounding the thighs with said first strap and attaching said first strap fasteners to each other surrounding the thighs of the handicapped individual;
(d) providing a handle joined to the other end of said seat;
(e) providing a second strap joined to said seat intermediate the ends thereof, said second strap having two ends and loop pile and hook fasteners provided thereon;
(f) surrounding the shoulders of the transporting person with said second strap and attaching said fasteners to each other;
(g) the transporting person transporting said handicapped individual by grasping said first strap with the hand of one arm and said handle with the hand of the other arm and distributing the weight of the handicapped individual between the transporting person's arms and shoulder surrounded by said second strap.

7. The method of claim 6 including:
(a) providing an extended handle having two ends attached substantially intermediate to said ends of said second strap and said seat, said extended handle forming a third strap;
(b) supporting the pelvis of said handicapped individual with said third strap.

8. The method of claim 7 including:
(a) providing a fourth strap having ends attached to said second strap above said third strap;
(b) supporting the back of the handicapped individual with said fourth strap.

* * * * *